US012781483B2

(12) United States Patent
Zhang et al.

(10) Patent No.: US 12,781,483 B2
(45) Date of Patent: Nov. 3, 2026

(54) PULL-OUT FAUCET

(71) Applicants: Xiamen Lota International Co., Ltd., Xiamen (CN); Lota Xiamen Industry Co. Ltd., Xiamen City (CN)

(72) Inventors: Yan Zhang, Xiamen (CN); Liming Ye, Xiamen (CN); Hao Li, Xiamen (CN); Xinzong Huang, Xiamen (CN); Chuanbao Zhu, Xiamen (CN)

(73) Assignees: Xiamen Lota International Co., Ltd., Xiamen (CN); Lota Xiamen Industry Co. Ltd., Xiamen City (CN)

( * ) Notice: Subject to any disclaimer, the term of this patent is extended or adjusted under 35 U.S.C. 154(b) by 88 days.

(21) Appl. No.: 19/004,558

(22) Filed: Dec. 30, 2024

(65) Prior Publication Data

US 2025/0382780 A1 Dec. 18, 2025

(30) Foreign Application Priority Data

Jun. 17, 2024 (CN) ..... 202410776201.4

(51) Int. Cl.
*E03C 1/04* (2006.01)

(52) U.S. Cl.
CPC .... *E03C 1/0404* (2013.01); *E03C 2001/0415* (2013.01)

(58) Field of Classification Search
CPC ..... E03C 1/0404; E03C 2001/0415
See application file for complete search history.

(56) References Cited

U.S. PATENT DOCUMENTS

2015/0368887 A1* 12/2015 Esche ..... E03C 1/0404 137/315.01
2022/0136224 A1* 5/2022 Yan ..... E03C 1/057 4/623
2022/0282463 A1* 9/2022 Zhang ..... E03C 1/0402

* cited by examiner

*Primary Examiner* — Christine J Skubinna
(74) *Attorney, Agent, or Firm* — COOPER LEGAL GROUP LLC

(57) ABSTRACT

A pull-out faucet includes a faucet body, a pull-out pipe, a magnetic sensing component, and a pull-out guiding component. The pull-out pipe is pullably disposed on the faucet body, and the pull-out guiding component is detachably disposed on the faucet body. The pull-out guiding component includes a pull-out channel, and the pull-out pipe is configured to pass through the pull-out channel. The magnetic sensing component includes a magnetic sensing switch and a magnetic component, and the magnetic component is disposed on the pull-out pipe. The magnetic sensing switch is disposed on the pull-out guiding component, and the magnetic sensing switch is adjacent to or disposed on an inner wall of the pull-out channel. When the pull-out pipe is moved in the pull-out channel, the magnetic component is aligned with or misaligned with the magnetic sensing switch.

10 Claims, 7 Drawing Sheets

PULL-OUT FAUCET

RELATED APPLICATIONS

This application claims priority to Chinese patent application number 202410776201.4, filed on Jun. 17, 2024. Chinese patent application number 202410776201.4 is incorporated herein by reference.

FIELD OF THE DISCLOSURE

The present disclosure relates to a pull-out faucet.

BACKGROUND OF THE DISCLOSURE

Existing pull-out sensing faucets require the water flow to be manually turned on before using the pull-out function for water collection or rinsing, and the switch must be operated again to turn off the water after use. This not only wastes water but also makes operation cumbersome, failing to provide a good user experience. To address these issues, the pull-out faucet is designed to automatically turn the water on and off by pulling out the spray head. Existing technology achieves this by incorporating a magnetic sensing switch within the faucet body, which results in a complex structure, imposes significant design requirements on the three-way body of the faucet, has a low degree of standardization, and is difficult to install.

BRIEF SUMMARY OF THE DISCLOSURE

The technical problem to be solved by the present disclosure is to provide a pull-out faucet.

In order to solve the above technical problems, the present disclosure provides a pull-out faucet. The pull-out faucet comprises a faucet body, a pull-out pipe, a magnetic sensing component, and a pull-out guiding component.

The pull-out pipe is pullably disposed on the faucet body, and the pull-out guiding component is detachably disposed on the faucet body. The pull-out guiding component comprises a pull-out channel, and the pull-out pipe is configured to pass through the pull-out channel.

The magnetic sensing component comprises a magnetic sensing switch and a magnetic component, and the magnetic component is disposed on the pull-out pipe. The magnetic sensing switch is disposed on the pull-out guiding component, and the magnetic sensing switch is adjacent to or disposed on an inner wall of the pull-out channel. When the pull-out pipe is moved in the pull-out channel, the magnetic component is aligned with or misaligned with the magnetic sensing switch.

In a preferred embodiment, the faucet body comprises a body portion and a mounting portion, and the mounting portion is connected to the body portion. The mounting portion is configured to correspond to a location below a countertop, and the pull-out guiding component is detachably disposed on the mounting portion.

In a preferred embodiment, the pull-out guiding component is disposed inside the mounting portion.

In a preferred embodiment, the mounting portion is tubular. A mounting channel is formed inside the mounting portion, and the pull-out guiding component is disposed in the mounting channel.

In a preferred embodiment, the pull-out guiding component is disposed adjacent to a first side of the mounting channel, and a pipe penetration space is formed on a second side of the mounting channel. The pipe penetration space is configured for pipelines to pass through.

In a preferred embodiment, the pull-out faucet further comprises a concealing cover, and a lower end of the pull-out guiding component is detachably connected to the concealing cover. The concealing cover and the lower end of the pull-out guiding component are buckled to the mounting portion, and the concealing cover comprises an opening connected to the pipe penetration space.

In a preferred embodiment, the pull-out guiding component comprises a mounting groove, and the magnetic sensing switch is detachably connected to the mounting groove.

In a preferred embodiment, the pull-out pipe is disposed with a solenoid valve, and the magnetic sensing switch is connected to the solenoid valve.

In a preferred embodiment, the pull-out faucet comprises a battery box weight, and the battery box weight is disposed on the pull-out pipe and is configured to supply power to the magnetic sensing switch and the solenoid valve.

In a preferred embodiment, the pull-out faucet comprises a sensing switch disposed on the faucet body. The sensing switch is connected to the solenoid valve, and the battery box weight is configured to supply power to the sensing switch.

Compared with the existing techniques, the technical solution has the following advantages.

1. The magnetic sensing component comprises the magnetic sensing switch and the magnetic component. The magnetic component is disposed on the pull-out pipe, and the magnetic sensing switch is disposed on the pull-out guiding component. The magnetic sensing switch is adjacent to or disposed on an inner wall of the pull-out channel. When the pull-out pipe is moved in the pull-out channel, the magnetic component is aligned with or misaligned with the magnetic sensing switch.

By placing the magnetic sensing switch adjacent to or on the inner wall of the pull-out channel and disposing the pull-out pipe in the pull-out channel during a pull-out process, a distance between the magnetic sensing switch and the magnetic component can be smaller to prevent malfunction.

2. The pull-out guiding component is detachably disposed on the faucet body, which can reduce requirements for a three-way faucet structure and make minor changes to the existing three-way faucet structure.

DETAILED DESCRIPTION OF THE EMBODIMENTS

Figure 1:
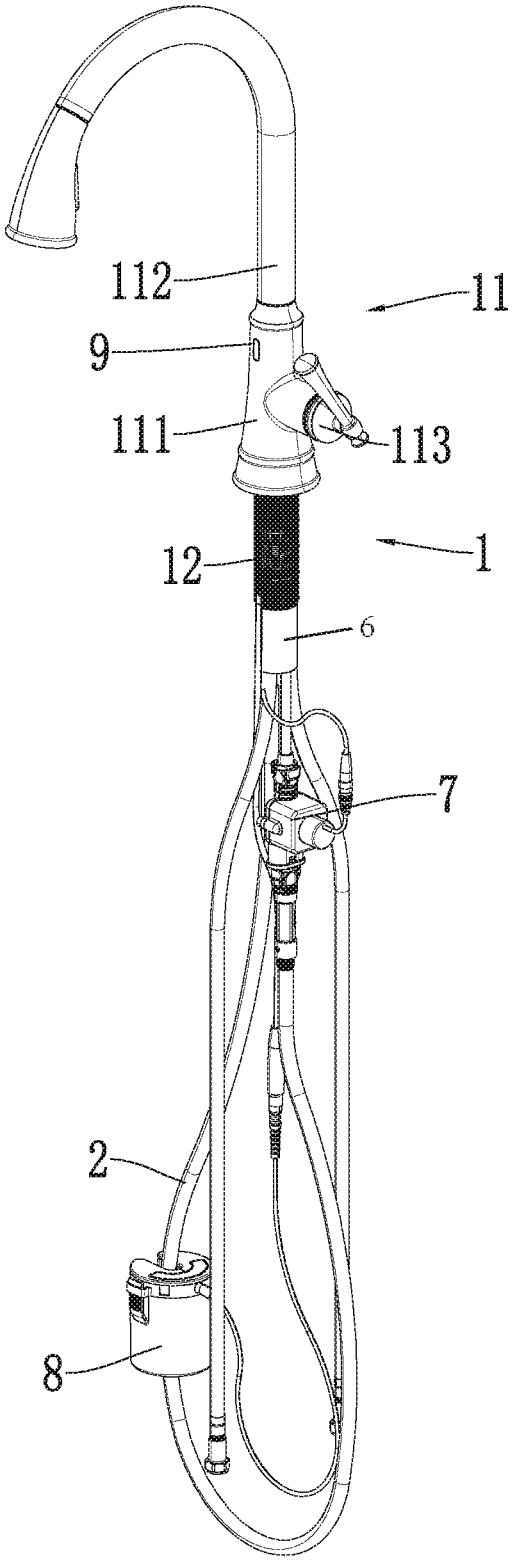
FIG. 1 is a perspective view of a pull-out faucet in a preferred embodiment of the present disclosure.

The following will clearly and completely describe the technical solutions in the embodiments of the present disclosure with reference to the accompanying drawings. Obviously, the described embodiments are only a portion of the embodiments of the present disclosure, and not all of the embodiments. Based on the embodiments of the present disclosure, all other embodiments obtained by those of ordinary skill in the art without creative work fall within the protection scope of the present disclosure.

In the description of the present disclosure, it should be noted that the terms "upper", "lower", "inner", "inner", "outer", "upper end", "lower end", etc. indicate the orientation or positional relationship based on the orientation shown in the drawings. The positional relationship is only for the convenience of describing the present disclosure and simplifying the description, rather than indicating or implying that the referenced device or element must have a specific orientation, be constructed, and be operated in a specific orientation. Therefore, the positional relationship should not be understood as a limitation of the present disclosure. In addition, the terms "first" and "second" are only used for descriptive purposes and should not be understood as indicating or implying relative importance.

In the description of the present disclosure, it should be noted that the terms "installed", "disposed with", "sleeved", "connected", etc., should be understood broadly. For example, "connected" can be a wall hanging connection, a detachable connection, or an integral connection, a mechanical connection, an electrical connection, a direct connection, or an indirect connection through an intermediate medium, and it can be a connection between two members. For those of ordinary skill in the art, the specific meaning of the above terms in the present disclosure can be understood under specific conditions.

Figure 2:
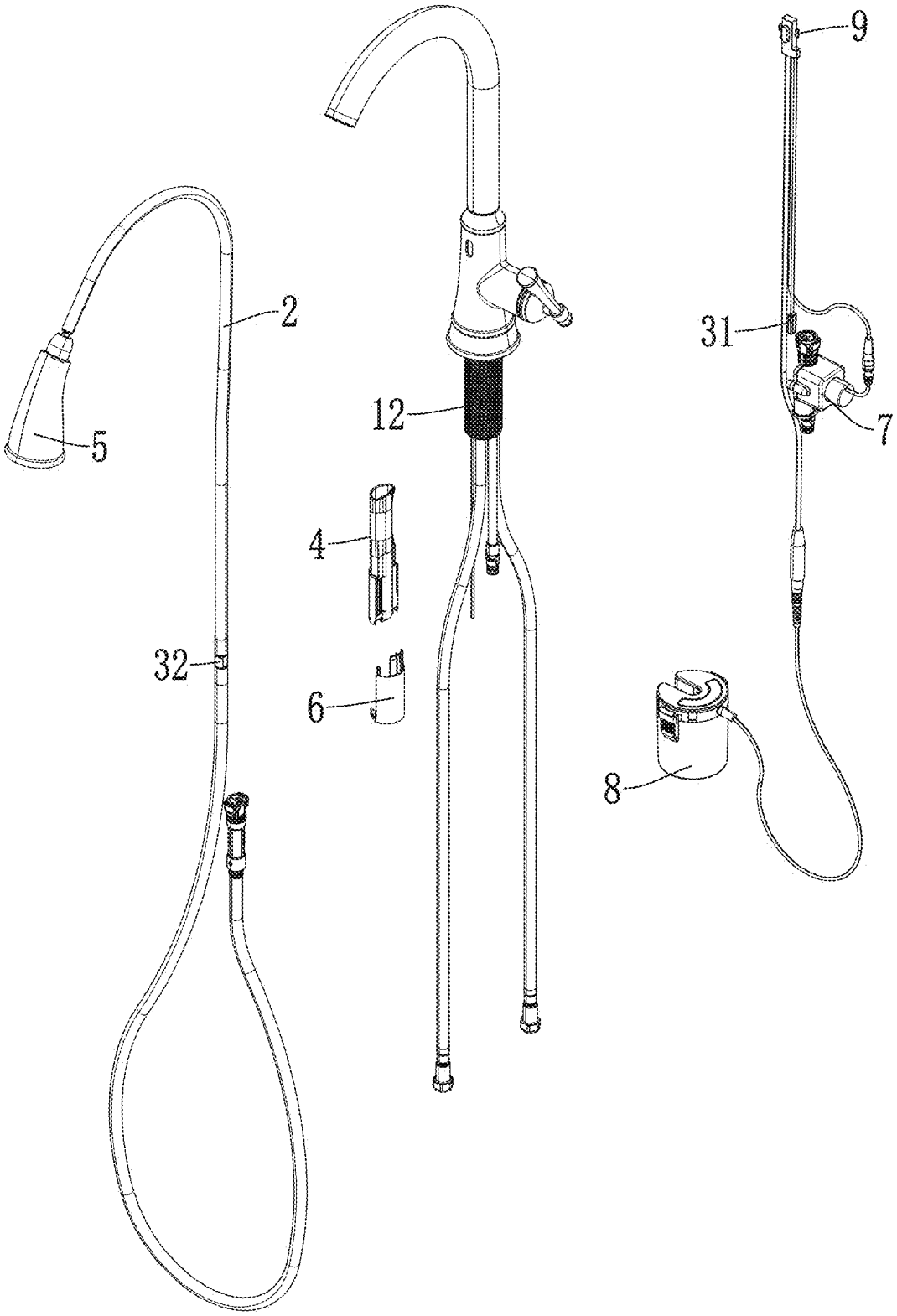
FIG. 2 is an exploded view of the pull-out faucet in the preferred embodiment of the present disclosure.
Figure 3:
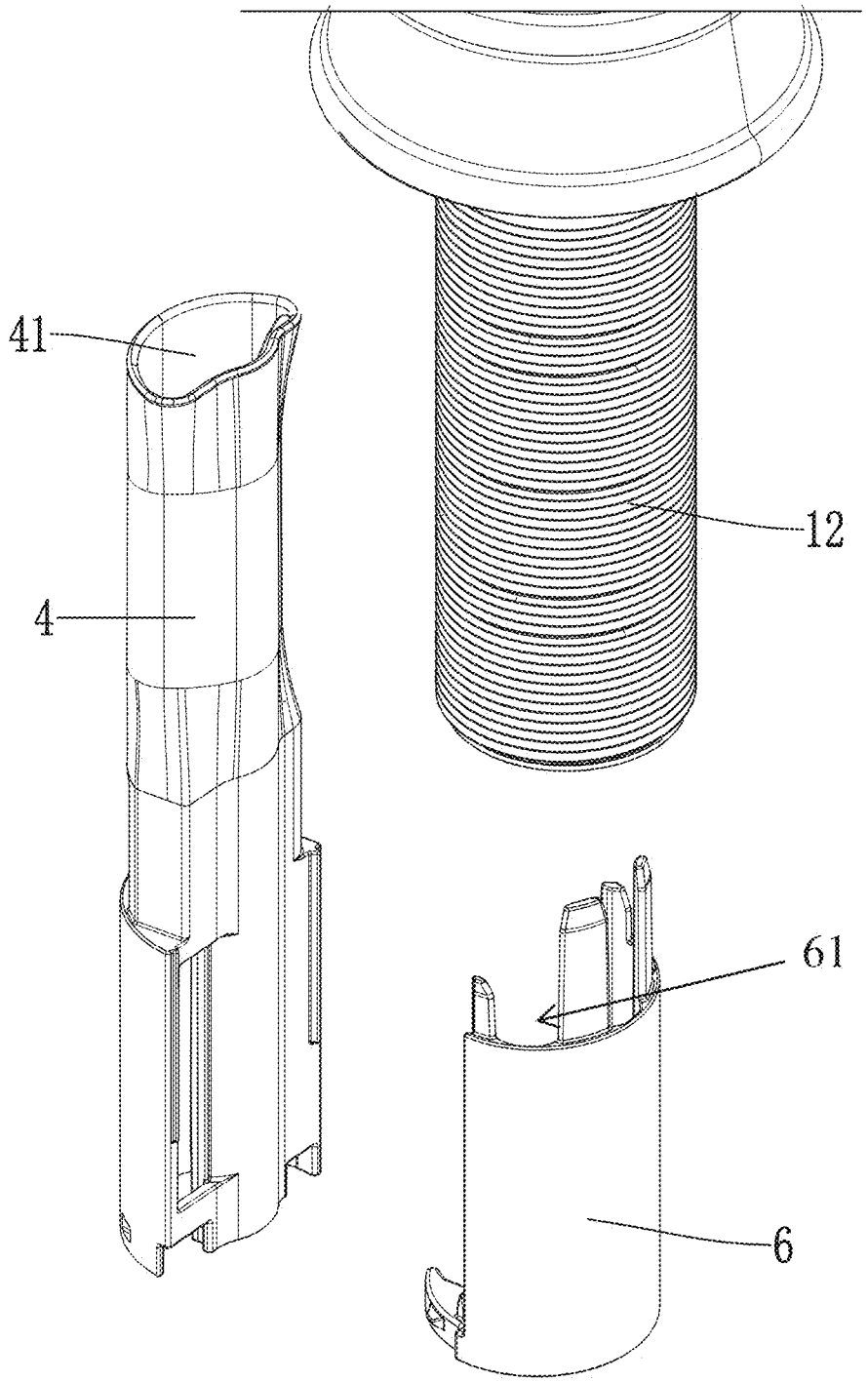
FIG. 3 is a perspective view of a pull-out guiding component, a concealing cover, and a mounting portion in the preferred embodiment of the present disclosure.
Figure 4:
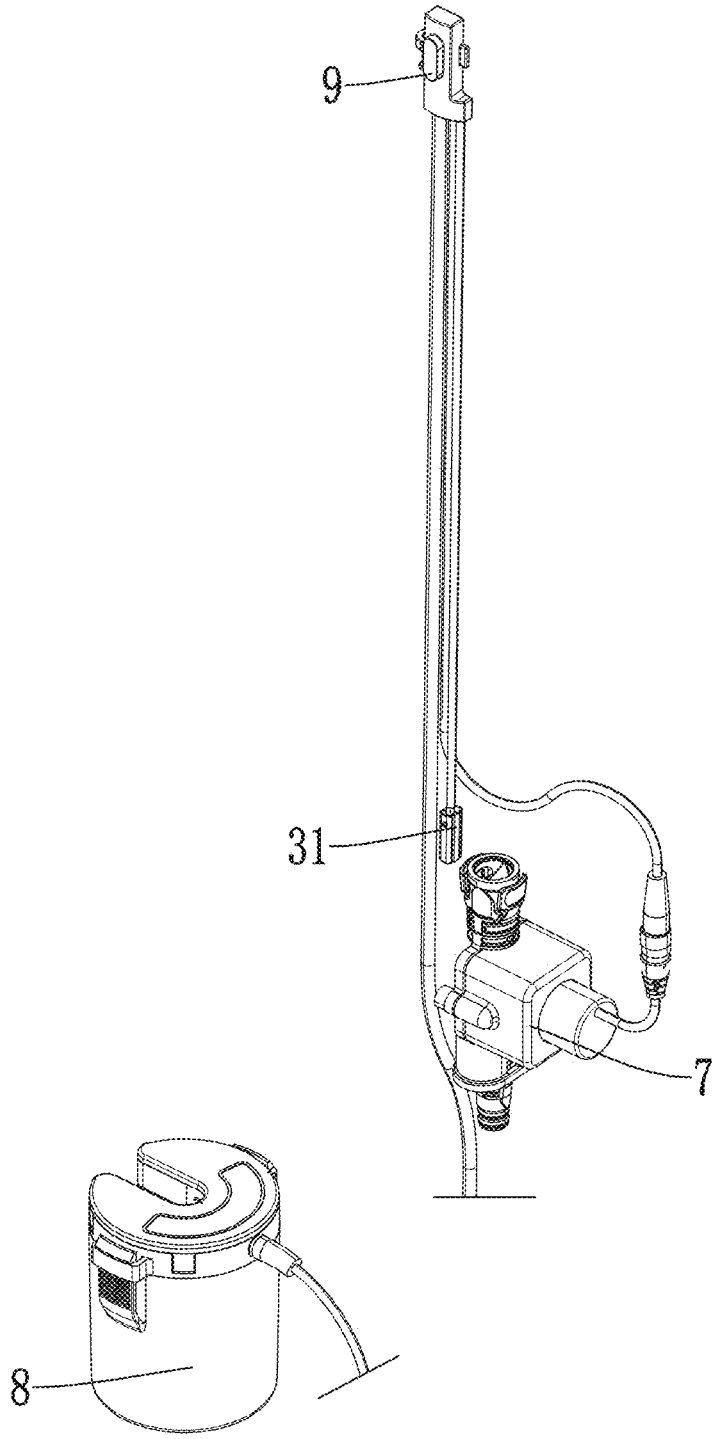
FIG. 4 is a perspective view of a battery box weight, a solenoid valve, a sensing switch, and a magnetic sensing switch in the preferred embodiment of the present disclosure.
Figure 5:
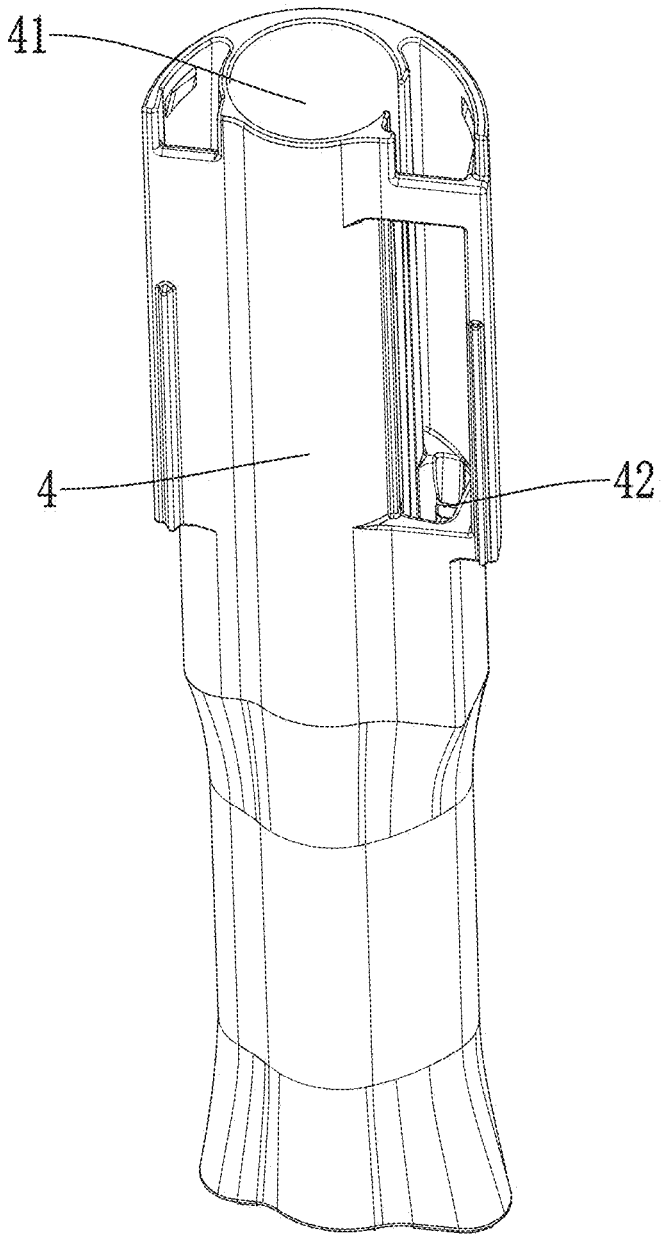
FIG. 5 is a perspective view of a pull-out guiding component in the preferred embodiment of the present disclosure.
Figure 6:
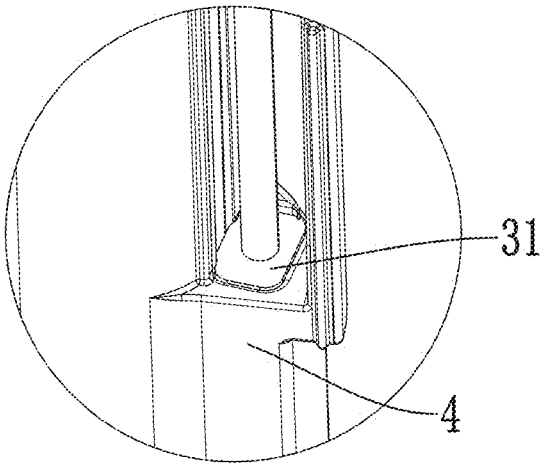
FIG. 6 is a perspective view of a connection between a pull-out guiding component and a magnetic sensing switch in the preferred embodiment of the present disclosure.
Figure 7:
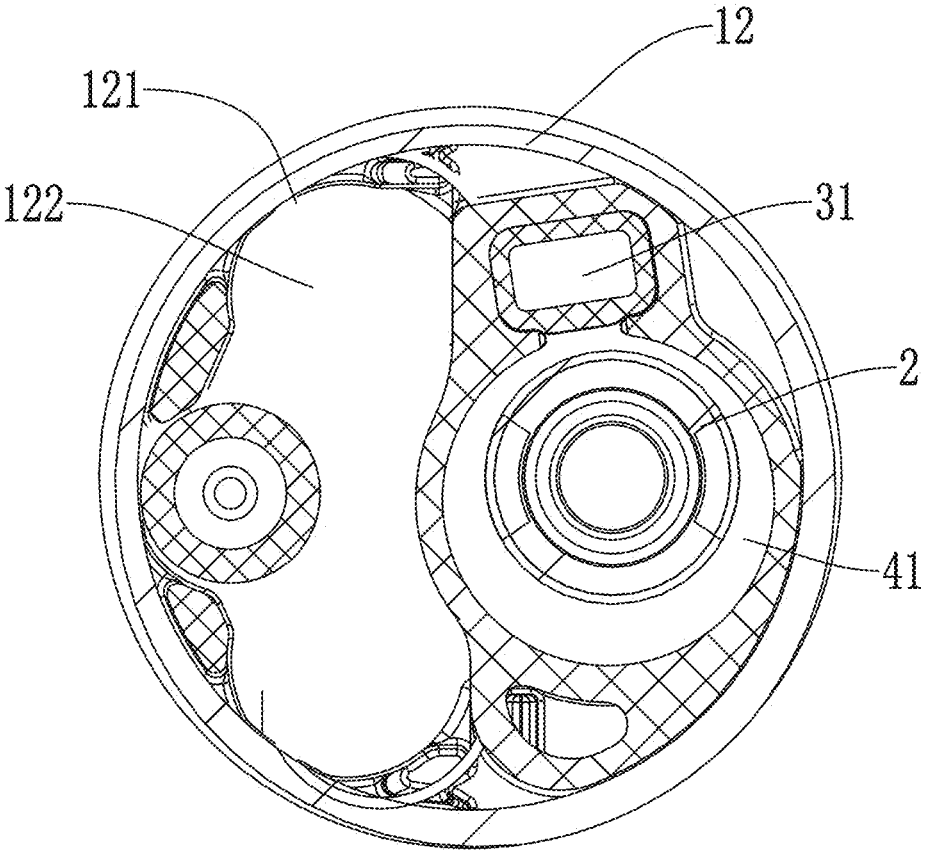
FIG. 7 is a cross-sectional view of the pull-out faucet in the preferred embodiment of the present disclosure.

Referring to FIGS. 1 to 7, a pull-out faucet is shown, and the pull-out faucet comprises a faucet body 1, a pull-out pipe 2, a magnetic sensing component, and a pull-out guiding component 4.

The faucet body 1 comprises a body portion 11 and a mounting portion 12. The body portion 11 comprises a three-way tube 111, a water outlet bent tube 112, and a valve assembly 113. The three-way tube 111 is disposed on a countertop, the water outlet bent tube 112 is connected to an upper end of the three-way tube 111, the valve assembly 113 is connected to a side end of the three-way tube 111, and the water outlet bent tube 112 can be rotated relative to the upper end of the three-way tube 111 to change a position of a distal end of the water outlet bent tube 112.

The mounting portion 12 is tubular and is disposed on a lower end of the three-way tube 111. The mounting portion 12 can pass through a mounting hole of the countertop from top to bottom to correspond to a location below the countertop. The mounting portion 12 can be a threaded tube, and a screw seat can be screwed on the threaded tube. The screw seat can abut a lower side of the countertop. Alternatively, the mounting portion 12 can also be other types of structures, as long as the faucet body 1 can be fixedly connected to the countertop.

The pull-out pipe 2 is pullably disposed on the faucet body 1. The pull-out guiding component 4 is detachably disposed on the faucet body 1. The pull-out guiding component 4 comprises a pull-out channel 41, and the pull-out pipe 2 passes through the pull-out channel 41. The magnetic sensing component comprises a magnetic sensing switch 31 and a magnetic component 32. The magnetic component 32 is disposed on the pull-out pipe 2, and the magnetic sensing switch 31 is disposed on the pull-out guiding component 4. The magnetic sensing switch 31 is adjacent to or disposed on an inner wall of the pull-out channel 41. When the pull-out pipe 2 is moved in the pull-out channel 41, the magnetic component 32 is aligned with or misaligned with the magnetic sensing switch 31.

A mounting channel 121 is formed inside the mounting portion 12, and the mounting channel 121 is connected to the three-way tube 111. A hot water pipe and a cold water pipe are respectively connected to the valve assembly 113 through the mounting channel 121. The valve assembly 113 receives hot water and cold water from the hot water pipe and the cold water pipe to form mixed water. A proximal end of the pull-out pipe 2 is connected to the valve assembly 113, and the mixed water is in communication with the pull-out pipe 2. The pull-out pipe 2 first passes through the mounting channel 121, then passes through the pull-out channel 41, and extends through the three-way tube 111 and the water outlet bent tube 112 until the pull-out pipe 2 passes through the distal end of the water outlet bent tube 112. A distal end of the pull-out pipe 2 is connected to a water outlet head 5, and the mixed water can be sprayed out from the water outlet head 5.

The pull-out guiding component 4 is detachably disposed on the mounting portion 12, and the pull-out guiding component 4 is disposed inside the mounting portion 12. Specifically, the pull-out guiding component 4 is disposed in the mounting channel 121. The pull-out guiding component 4 is disposed adjacent to a first side of the mounting channel 121, and a pipe penetration space 122 is formed on a second side of the mounting channel 121. The pipe penetration space 122 is configured for pipelines to pass through. In this embodiment, after the proximal end of the pull-out pipe 2 is connected to the valve assembly 113, the distal end of the pull-out pipe 2 first passes through the pipe penetration space 122, then the distal end of the pull-out pipe 2 passes through the pull-out channel 41, and finally the distal end of the pull-out pipe 2 passes through the distal end of the water outlet bent tube 112.

The magnetic sensing switch 31 is disposed inside the pull-out guiding component 4, and the magnetic component 32 is disposed on the pull-out pipe 2. The magnetic component 32 is a magnet that is insert-molded on the pull-out pipe 2. When the magnetic component 32 corresponds to the magnetic sensing switch 31, the water outlet head 5 abuts the distal end of the water outlet bent tube 112. When the water outlet head 5 is pulled to drive the pull-out pipe 2 to move, the magnetic component 32 is misaligned with the magnetic sensing switch 31. In this embodiment, when the magnetic component 32 is aligned with the magnetic sensing switch 31, the pull-out pipe 2 does not discharge water, and when the magnetic component 32 is misaligned with the magnetic sensing switch 31 by a specific distance, the pull-out pipe 2 discharges water.

Alternatively, when the magnetic component 32 is misaligned with the magnetic sensing switch 31, the water outlet head 5 abuts the distal end of the water outlet bent tube 112, and when the water outlet head 5 is pulled to drive the pull-out pipe 2 to move, the magnetic component 32 is aligned with the magnetic sensing switch 31. That is, when the magnetic component 32 is aligned with the magnetic sensing switch 31, the pull-out pipe 2 discharges water, and when the magnetic component 32 is misaligned with the magnetic sensing switch 31 by a specific distance, the pull-out pipe 2 does not discharge water.

The pull-out faucet further comprises a concealing cover 6. A lower end of the pull-out guiding component 4 is detachably connected to the concealing cover 6, and the concealing cover 6 and the lower end of the pull-out guiding component 4 are buckled to the mounting portion 12. The concealing cover 6 comprises an opening 61 connected to the pipe penetration space 122. In this embodiment, an upper end of the pull-out guiding component 4 is inserted into the mounting channel 121, and the lower end of the pull-out guiding component 4 is exposed from the lower end of the mounting channel 121. An upper end of the concealing cover 6 is inserted into the mounting channel 121, and a lower end of the cover 6 is also exposed from the lower end of the mounting channel 121 and is buckled to the pull-out guiding component 4. A depth of the concealing cover 6 inserted into the mounting channel 121 is relatively shallow, and the concealing cover 6 cooperates with the pull-out guiding component 4 to secure the pull-out guiding component 4 on the mounting portion 12.

The pull-out guiding component 4 comprises a mounting groove 42, and the magnetic sensing switch 31 is detachably connected to the mounting groove 42. In this embodiment, the magnetic sensing switch 31 is connected to the mounting groove 42 in a snap-connection manner.

The pull-out pipe 2 is disposed with a solenoid valve 7, and the magnetic sensing switch 31 is connected to the solenoid valve 7. The solenoid valve 7 can be used to control a turning on and off of the pull-out pipe 2, and the magnetic sensing switch 31 can be connected to the solenoid valve 7 to achieve a corresponding water outlet function.

The pull-out faucet further comprises a battery box weight 8, and the battery box weight 8 is disposed on the pull-out pipe 2 and is configured to supply power to the magnetic sensing switch 31 and the solenoid valve 7. The pull-out faucet further comprises a sensing switch 9 disposed on the faucet body 1. The sensing switch 9 is connected to the solenoid valve 7, and the battery box weight 8 is configured to supply power to the sensing switch 9. The battery box weight 8 can not only serve as a weight for the pull-out pipe 2, but also serve as a power supply for the above-mentioned components.

During use, the user can pull the water outlet head 5, so that the pull-out pipe 2 is driven to make the magnetic component 32 be misaligned with the magnetic sensing switch 31, and then the solenoid valve 7 is controlled to make the solenoid valve 7 be turned on to supply water. When the user releases the water outlet head 5, the pull-out pipe 2 is driven by the battery box weight 8 to drive the water outlet head 5 to move back to an initial position. At this time, the magnetic component 32 is aligned with the magnetic sensing switch 31, and the solenoid valve 7 is turned off. When the user wants to discharge water without pulling out the water outlet head 5, the user can wave his/her hand so that the sensing switch 9 senses the presence of the hand, so that the solenoid valve 7 is turned on. The user can wave his hand again to enable the sensing switch 9 to sense the presence of the hand to turn off the solenoid valve 7 to stop the water.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A pull-out faucet, comprising:
a faucet body,
a pull-out pipe,
a magnetic sensing component, and
a pull-out guiding component, wherein:
the pull-out pipe is pullably disposed on the faucet body,
the pull-out guiding component is detachably disposed on the faucet body,
the pull-out guiding component comprises a pull-out channel,
the pull-out pipe is configured to pass through the pull-out channel,
the magnetic sensing component comprises a magnetic sensing switch and a magnetic component,
the magnetic component is disposed on the pull-out pipe,
the magnetic sensing switch is disposed on the pull-out guiding component,
the magnetic sensing switch is adjacent to or disposed on an inner wall of the pull-out channel,
the faucet body comprises a body portion and a mounting portion,
the mounting portion is connected to the body portion,
the mounting portion is configured to correspond to a location below a countertop,
the pull-out guiding component is detachably disposed on the mounting portion, and
when the pull-out pipe is moved in the pull-out channel, the magnetic component is aligned with or misaligned with the magnetic sensing switch.

2. The pull-out faucet according to claim 1, wherein:
the pull-out guiding component is disposed inside the mounting portion.

3. The pull-out faucet according to claim 1, wherein:
the mounting portion is tubular,
a mounting channel is formed inside the mounting portion, and
the pull-out guiding component is disposed in the mounting channel.

4. The pull-out faucet according to claim 3, wherein:
the pull-out guiding component is disposed adjacent to a first side of the mounting channel,
a pipe penetration space is formed on a second side of the mounting channel, and
the pipe penetration space is configured for pipelines to pass through.

5. The pull-out faucet according to claim 4, wherein:
the pull-out faucet further comprises a concealing cover,
a lower end of the pull-out guiding component is detachably connected to the concealing cover,
the concealing cover and the lower end of the pull-out guiding component are buckled to the mounting portion, and
the concealing cover comprises an opening connected to the pipe penetration space.

6. The pull-out faucet according to claim 1, wherein:
the pull-out guiding component comprises a mounting groove, and
the magnetic sensing switch is detachably connected to the mounting groove.

7. The pull-out faucet according to claim 1, wherein:
the pull-out pipe is disposed with a solenoid valve, and
the magnetic sensing switch is connected to the solenoid valve.

8. The pull-out faucet according to claim 7, comprising:
a battery box weight, wherein:
the battery box weight is disposed on the pull-out pipe and is configured to supply power to the magnetic sensing switch and the solenoid valve.

9. The pull-out faucet according to claim 8, comprising:
a sensing switch disposed on the faucet body, wherein:
the sensing switch is connected to the solenoid valve, and
the battery box weight is configured to supply power to the sensing switch.

10. A pull-out faucet, comprising:
a faucet body,
a pull-out pipe,
a magnetic sensing component,
a battery box weight, and
a pull-out guiding component, wherein:
the pull-out pipe is pullably disposed on the faucet body,
the pull-out guiding component is detachably disposed on the faucet body,
the pull-out guiding component comprises a pull-out channel,
the pull-out pipe is configured to pass through the pull-out channel,
the magnetic sensing component comprises a magnetic sensing switch and a magnetic component,
the magnetic component is disposed on the pull-out pipe,
the magnetic sensing switch is disposed on the pull-out guiding component,
the magnetic sensing switch is adjacent to or disposed on an inner wall of the pull-out channel,
the pull-out pipe is disposed with a solenoid valve,
the magnetic sensing switch is connected to the solenoid valve,
the battery box weight is disposed on the pull-out pipe and is configured to supply power to the magnetic sensing switch and the solenoid valve, and
when the pull-out pipe is moved in the pull-out channel, the magnetic component is aligned with or misaligned with the magnetic sensing switch.

* * * * *